US007117638B2

(12) United States Patent
Ihashi

(10) Patent No.: US 7,117,638 B2
(45) Date of Patent: Oct. 10, 2006

(54) VEHICLE DOOR OPEN-CLOSE DEVICE

(75) Inventor: Yoshitomo Ihashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/348,925

(22) Filed: Jan. 21, 2003

(65) Prior Publication Data

US 2003/0145524 A1 Aug. 7, 2003

(30) Foreign Application Priority Data

Feb. 5, 2002 (JP) ..... 2002-027794

(51) Int. Cl.
*E05F 15/10* (2006.01)

(52) U.S. Cl. ..... 49/340; 49/344; 296/56

(58) Field of Classification Search ..... 49/339, 49/340, 341, 342, 344, 345; 296/56
See application file for complete search history.

(56) References Cited

U.S. PATENT DOCUMENTS 6,092,337 A * 7/2000 Johnson et al. ..... 49/340
6,142,551 A * 11/2000 Ciavaglia et al. ..... 296/56
6,283,535 B1 * 9/2001 Yuge ..... 296/146.8
6,382,706 B1 * 5/2002 Yuge et al. ..... 296/146.4
6,401,392 B1 * 6/2002 Yuge ..... 49/340
6,405,486 B1 * 6/2002 Rogers et al. ..... 49/339
6,513,859 B1 * 2/2003 Yuge ..... 296/146.4
6,637,157 B1 * 10/2003 Dombrowski et al. ..... 49/341
6,834,463 B1 * 12/2004 Fukumoto et al. ..... 49/341
6,871,449 B1 * 3/2005 Ihashi ..... 49/339
6,929,310 B1 * 8/2005 Okada ..... 296/146.8
6,964,449 B1 * 11/2005 Takeda et al. ..... 296/146.4
2001/0008057 A1 * 7/2001 Sakaue et al. ..... 49/341
2003/0079413 A1 * 5/2003 Fukumoto et al. ..... 49/341

FOREIGN PATENT DOCUMENTS

JP 2000-335245 12/2000

* cited by examiner

*Primary Examiner*—Jerry Redman
(74) *Attorney, Agent, or Firm*—Hamre, Schumann, Mueller & Larson, PC

(57) ABSTRACT

A vehicle door open-close device which makes it possible to achieve a reduction in numbers of parts and also make the deflection width size of a member 5 small, to thereby allow an effective use of a vehicle compartment to be aimed at, is produced, comprising a driving mechanism positioned inwardly from a door opening, an operation transfer mechanism to connect this driving mechanism and the vehicle door, the operation transfer mechanism being equipped with a slider member reciprocatingly and linearly moving by the aid of the driving means, and a link member connecting this slider member and the vehicle door, wherein the link member is rotatably connected to the slider member and the vehicle door, and the link member includes a straight portion and a curved portion outwardly and protrudingly curved away from a center of rotation of the vehicle door, and a straight portion 5*b* formed in substantially straight line in a connection part 8. And in a process of fully-opening-state or fully-closing-state of the door, the curved portion passes across the door opening seen from the rotation axis direction.

8 Claims, 3 Drawing Sheets

VEHICLE DOOR OPEN-CLOSE DEVICE

FIELD OF THE INVENTION

The present invention relates to a vehicle door open-close device.

BACKGROUND OF THE INVENTION

As an open-close equipment which opens and closes the back door of vehicles by power, JP-A-2000-335245 proposes a technology wherein a rack axis is moved by an electric motor and an arm member fixed to the back door is driven through a link member connected to the rack axis, so as to open-and-close the back door.

This technology is arranged in such a manner that in case where a through hole for an insertion of an arm member is prepared, the arm member is arcuately formed centering on the axial center of the back door, in order to make the size of this through hole small as much as possible, that is, in order to make the deflection width size of the arm member small, and the arm member is fixed to the back door.

According to the above-described conventional technology, circumferential edge of an arm member in a vehicle compartment also arcuately moves. Therefore, another link member for rotatably connecting the circumferential edge of a vehicle compartment and a rack axis is needed. This pushed up the number of parts and posed a problem that accuracy in mounting process is hard to obtain. In addition, space for securing the rotation range of a free end portion of the arm member is needed, to thereby pose another problem that vehicles compartment becomes narrower correspondingly.

SUMMARY OF THE INVENTION

This invention is devised in order to overcome the aforementioned problems and provides a door open-close device of vehicles, wherein reduction in number of parts is achieved and a deflection width size of the member which passes the door opening or a through hole becomes small to thereby allow an effective use of a vehicle compartment to be aimed at.

In order to overcome the above-described problems, a vehicle door open-close device in which opening-and-closing operation of the door provided in a vehicle body is carried out by electric power is provided, said vehicle door open-close device comprising a driving mechanism positioned inwardly from a door opening, an operation transfer mechanism to interconnect this driving mechanism and the door, said operation transfer mechanism being equipped with a slider member reciprocatingly and linearly moving by the aid of the driving mechanism, and a link member connecting this slider member and the vehicle door, wherein said link member is rotatably connected to the slider member and the vehicle door, and said link member includes a straight portion and a curved portion outwardly and protrudingly curved away from a center of rotation of the vehicle door, in the process of full-opening-state or full-closing-state of the door, and wherein said curved portion passes across the door opening viewed from the rotation axis of the door.

By the above, an arrangement with only a link member itself, that is, with only a few numbers of parts can be achieved. And along with this, deflection width size of a member can be made small, for example the interference degree of the load loaded into the circumference of opening and a link member can be reduced. Also, when a through hole is prepared for the link member to be inserted, the size of the through hole can be made small. Furthermore, since the link member moves so that a parabolic curve may be drawn without being regulated by the motion on the arc centering on an axial pin, the moving range in vehicles compartment can be made small as much as possible, to enable an effective use of the space of the vehicles compartment. Whereby, it is easily adapted to the existing vehicles having restricted use space.

Also, a door open-close device of a vehicle devised to open-and-close the door provided in a vehicle body driven by electric power, comprises a driving mechanism positioned inwardly from a door opening, the operation transfer mechanism being equipped with a slider member reciprocatingly and linearly moving by the aid of the driving mechanism, and a link member connecting the slider member and the vehicle door wherein said link member is rotatably connected to the slider member and the vehicle door, and said link member includes a straight portion and a curved portion outwardly and protrudingly curved away from a center of rotation of the vehicle door, and wherein said curved portion passes across the door opening in the process of a fully opening and fully closing state of the vehicle door.

By the above, an arrangement with only a link member itself, that is, with only a few numbers of parts can be achieved. And along with this, deflection width size of a member can be made small, for example the interference degree of the load loaded into the circumference of the opening and a link member can be reduced. Also, when a through hole is prepared for the link member to be inserted, the size of the through hole can be made small. Furthermore, since the link member moves so that a parabolic locus may be traced without being regulated by the motion on the arc centering on an axial pin, the moving range in vehicles compartment can be made small as much as possible, to enable an effective use of the space of the vehicles compartment. Whereby, it is easily adapted to the existing vehicles having a restricted use space. Furthermore by formation of a straight portion, since the connection part of a link member and a door is spaced apart from a rotation center of the door, a driving force by a driving mechanism required for an opening and closing of the door can be small. Also, since a connection part will be located in the space opened comparatively wide, the flexibility of a design of the circumference of a connection part spreads, and assembling work also becomes easy.

Moreover, the link member, the slider member and the door are connected by 3-dimensional joint mechanism, such as ball joint or a universal joint. This device permits a 3-dimensional rotation as well as a rotation to the rotating direction of a door only. The variation in size of a mounting device in the vehicle body and the door can be thus absorbed, to allow a smooth opening-and-closing operation of a door. Moreover, since the internal variation of a driving mechanism is also absorbable, the transfer efficiency of the driving force to a slider member can also be raised.

Furthermore, by employment of the arrangement in such a manner that a connection part of the link member and the slider member is inwardly disposed from the opening, with the door fully opened, good appearance can be presented and the influence of the rainstorm to the connection part can be reduced as much as possible.

BRIEF DESCRIPTION OF THE DRAWINGS

FIG. 2A shows a door in a full-opening state using the vehicle door open-close device of FIG. 1: FIG. 2B shows a door in a full-closing state using the vehicle door open-close device of FIG. 1.

FIG. 3A represents an action explanatory view showing a vehicle door open-close device in accordance with the principles of the present invention: FIG. 3B represents an explanatory view showing another embodiment of a vehicle door open-close device where a link member is formed of a straight portion.

PREFERRED EMBODIMENT OF THE INVENTION

Figure 1:
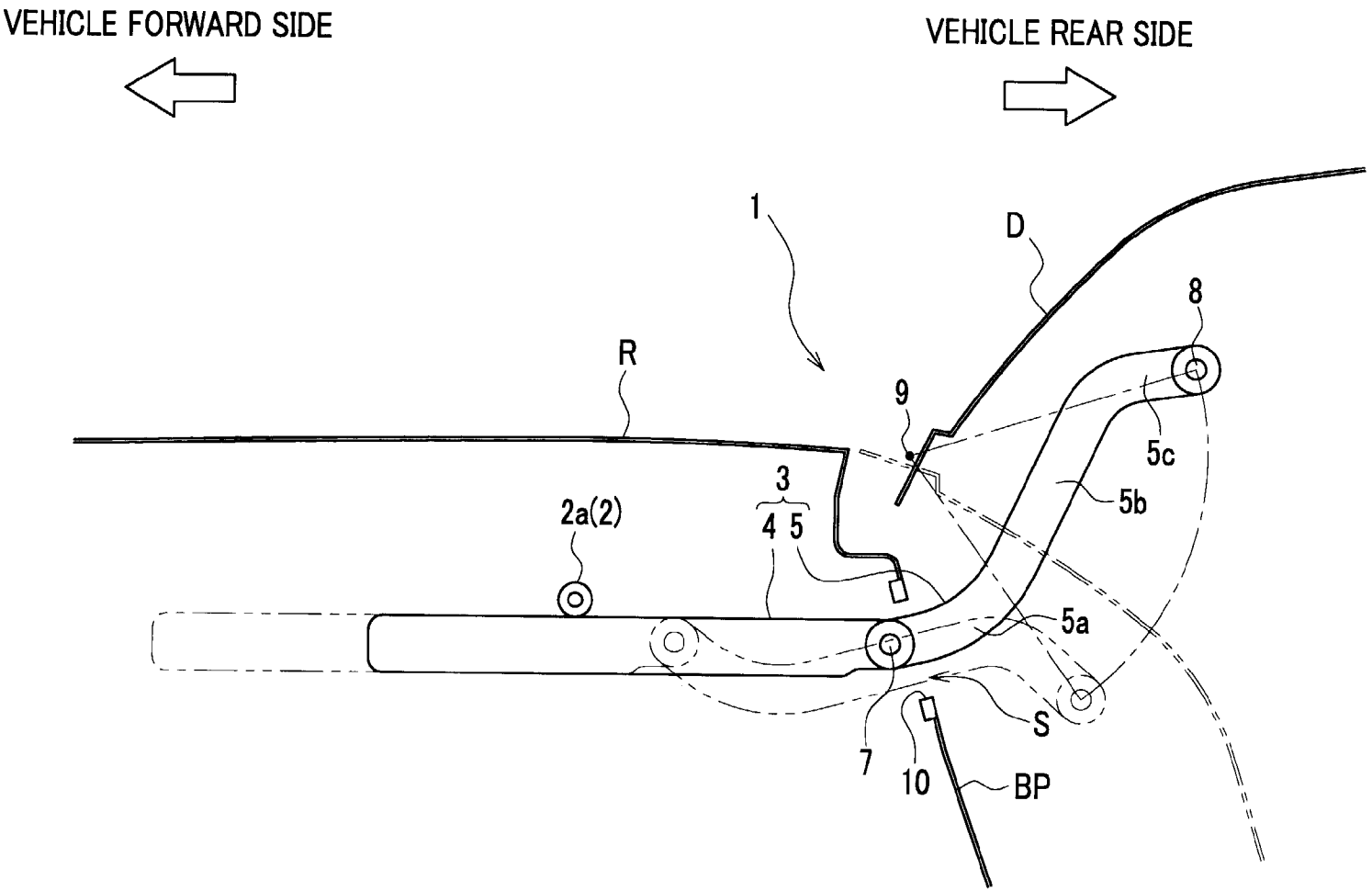
FIG. 1 is an explanatory side view showing a vehicle door open-close device.
Figure 2A:
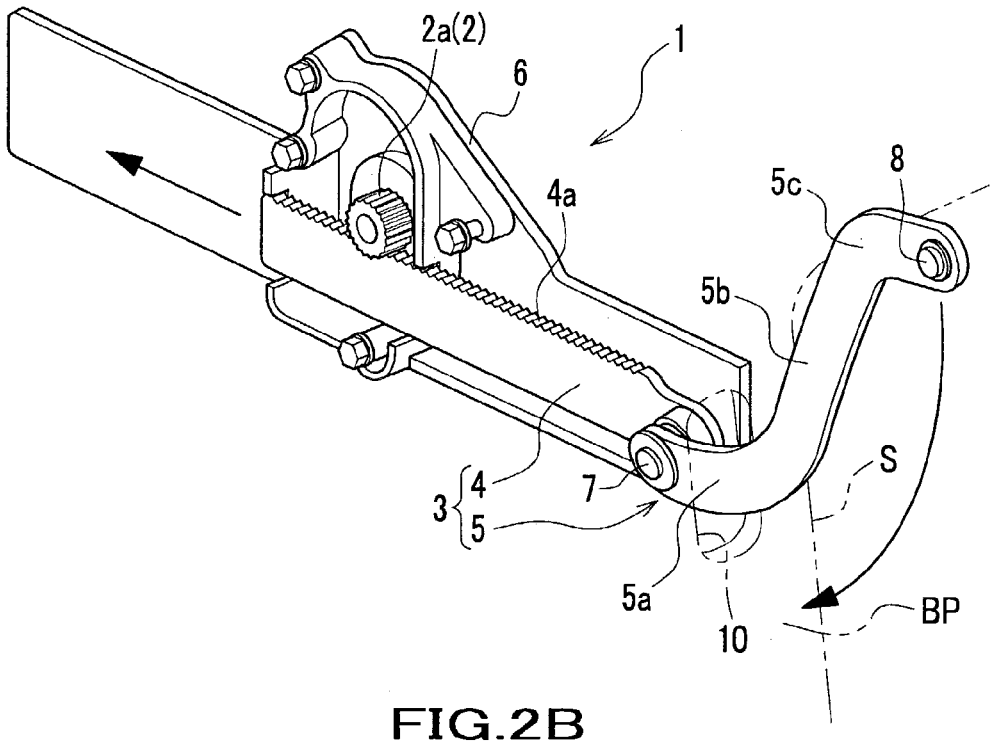
FIGS. 2A and 2B represent perspective views showing a vehicle door open-close device.
Figure 2B:
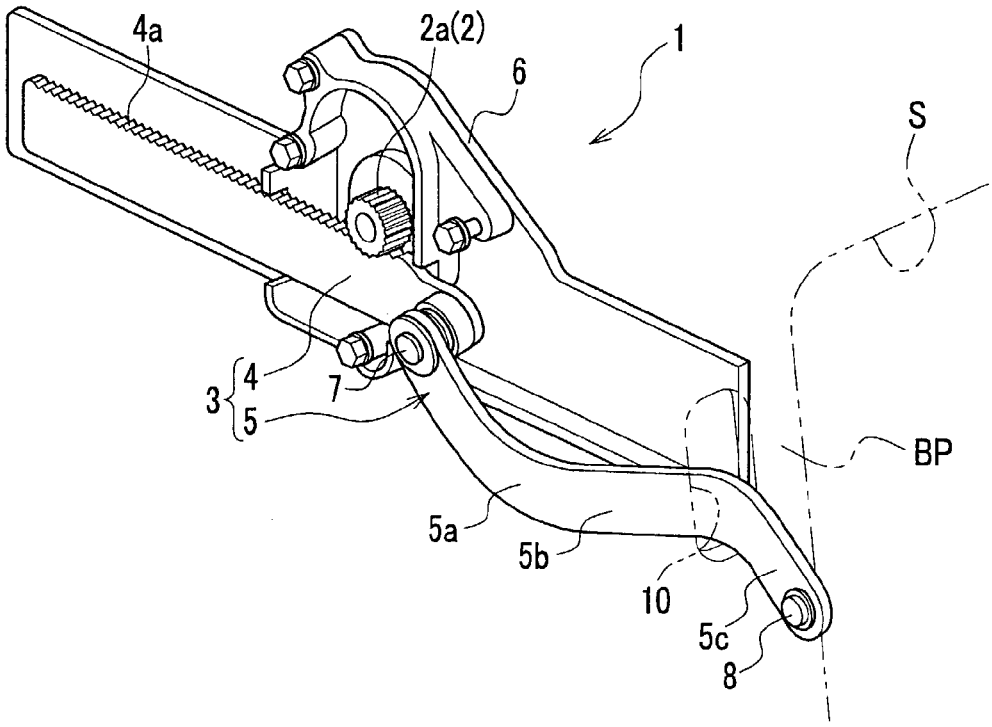

Preferred embodiment of the invention will now be explained with reference to the drawings. FIG. 1 is an explanatory side view showing a door open-close device, and FIG. 2 is a perspective view of the same, wherein door full-opening-state is represented in FIG. 2A, and door full-closing-state is represented in FIG. 2B.

A door open-close device adapted to a back door (referred as merely door hereinafter) D of a wagon vehicle as one mode of the invention is shown in FIG. 1. A door open-close device 1 which adopts a door open-close device of this invention will now be explained hereinafter. A door open-close device 1 has a driving mechanism 2 positioned within a vehicle compartment (indicating a part surrounded by a vehicle rear circumferential edge panel BP shown in FIG. 1, also see FIG. 2) and an operation transfer mechanism 3 to interconnect the driving mechanism 2 and door D.

An electric motor (not shown) etc. is used as a driving mechanism 2. An operation transfer mechanism 3 includes a slider member 4 which is reciprocatingly and linearly moving by the aid of the driving mechanism 2, and a link member 5 which interconnects the slider member 4 and door D.

A slider member 4 is constituted as a tabular member which is supported by a bracket 6 provided in the vehicles compartment and carries out reciprocating rectilinear motion longitudinally in the direction of vehicles, as shown in FIG. 2. In this embodiment, rack and pinion mechanisms are used as means so that a slider member 4 may reciprocatingly and linearly move. This rack and pinion mechanisms are arranged in such a manner that rack gear 4*a* is formed longitudinally along the vehicle in an upper part of the slider member 4, and with this rack gear 4*a*, the output axis of the driving mechanism 2 (electric motor etc.) is meshed directly, or an output gear 2*a* provided through such as gear device is meshed. With this arrangement, output gear 2*a* carries out a right reverse rotation to allow the slider member 4 to carry out reciprocating rectilinear motion longitudinally in the direction of vehicles.

A link member 5 is rotatably connected to a slider member 4 or door D on the end side and another end side thereof respectively. Specifically, the end side of the link member 5 is connected to a part of the slider member 4 in vehicle rear side through a connection part 7 so as to be capable of a rotating motion about the axis in the vehicles width direction. Whereas, another end side of the link member 5 is connected to a bracket, which is not shown, installed fixedly in door D through a connection part 8 so as to be capable of a rotating motion about the axis in the vehicles width direction. Namely, the connection part 7 is formed so as to carry out reciprocating rectilinear motion longitudinally in the direction of vehicles, and the connection part 8 is formed so as to carry out rotating motion about a rotation center 9 of the door D centering on a rotation axis in the vehicles width direction.

As shown in FIG. 1, the rotation center 9 of door D is located near the back end of a roof R of a vehicle body. The connection part 7 is located lower than the rotation center 9 seen from the rotation axis of door D, and when a slider member 4 is in a maximum advancing state, that is, door D is in a full-closing state, the connection part 7 is spaced apart most from the rotation center 9, whereas when the slider member 4 is in a maximum retreating state, that is, door D is in a full opening state, position is taken approaching the rotation center 9 most. As shown in FIG. 1, with this embodiment, the connection part 7 is inwardly positioned (vehicles compartment side) from an opening S, seen from a rotation axis direction of the door D.

A connection part 8 is located lower than a rotation center 9 in a full closing state of door D, and is located in a vehicle rear side more backwardly than the rotation center 9. And the connection part 8 in a full opening state of door D is positioned more upwardly than the rotation center 9, and more backwardly than the position in a full closing state of door D.

A link member 5 includes a curved portion 5*a* and a straight portion 5*b*. The curved portion 5*a* is outwardly and protrudingly curved away from a center of rotation of the vehicle door, in the profile of protruding downward in this embodiment in the connection part with a slider member 4, that is, a connection part 7. Whereas the straight portion 5*b* formed in substantially straight line is positioned in the connection part with door D, that is, a connection part 8. In other word, the curved portion 5*a* is formed so as to be outwardly and protrudingly curved away from a center of rotation of the vehicle door against a straight portion which is a connection part with door D. In addition, a link member 5 as shown in the drawing, in view of the attachment position to door D, is crooked in the end portion of the straight portion 5*b* so that crookedness portion 5*c* may be formed, having a connection part 8 formed on tip end of this crookedness portion 5*c*. However, the existence of formation of this crookedness portion 5*c*is a composition element chosen suitably or optionally.

In the process of a full opening state and a full closing state of door D, a link member 5 is arranged so as to pass across opening S seen from the rotation axis direction of door D. A through hole as disclosed in the aforementioned JP-A-2000-335245, that is, in outside of the inner peripheral edge of opening S, a through hole 10 is formed on the back end panel BP separately. Then, the link member 5 is inserted into this through hole 10. This through hole 10 is formed to be flush with opening S seen from the rotation axis direction of door D as shown in FIG. 1.

Figure 3A:
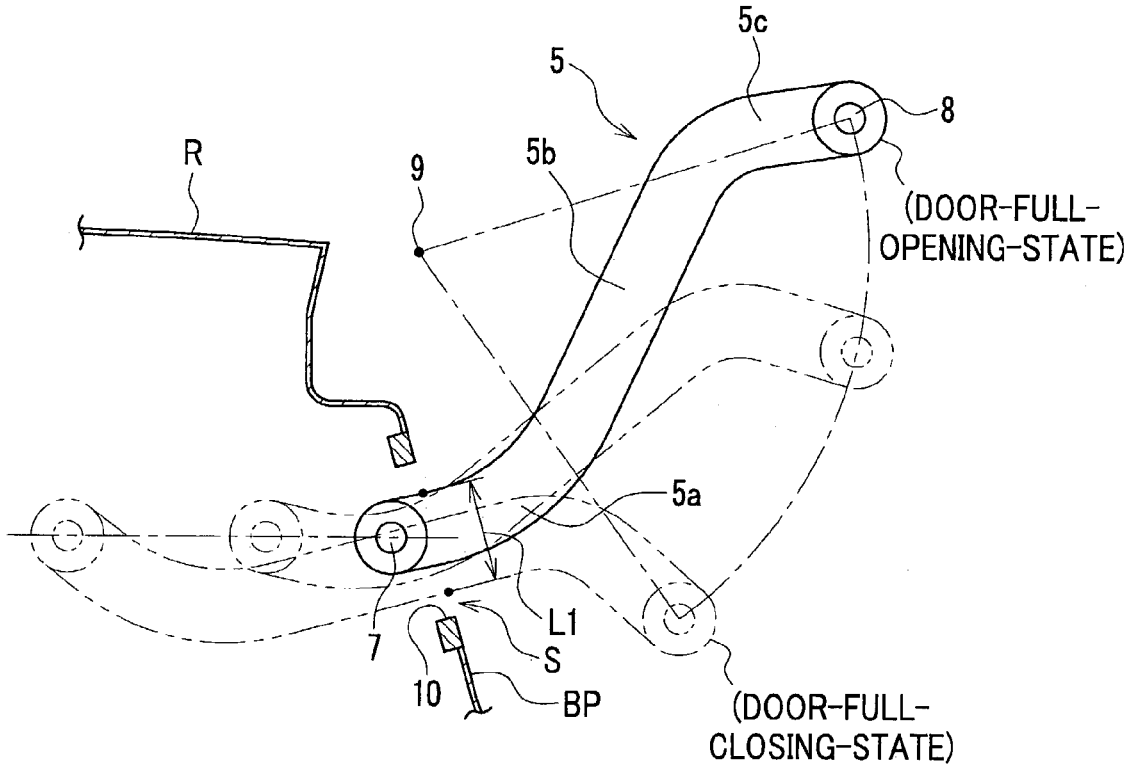
FIGS. 3A and 3B represent action explanatory views showing other vehicle door open-close devices.

Action of a link member 5 will be explained in conjunction with FIG. 3. FIG. 3A is an action explanatory view of this invention, and FIG. 3B is an action explanatory view in case where the link member (shown by numeral 31) is formed with a straight portion only without including a curved portion in order to contrast with this invention.

Figure 3B:
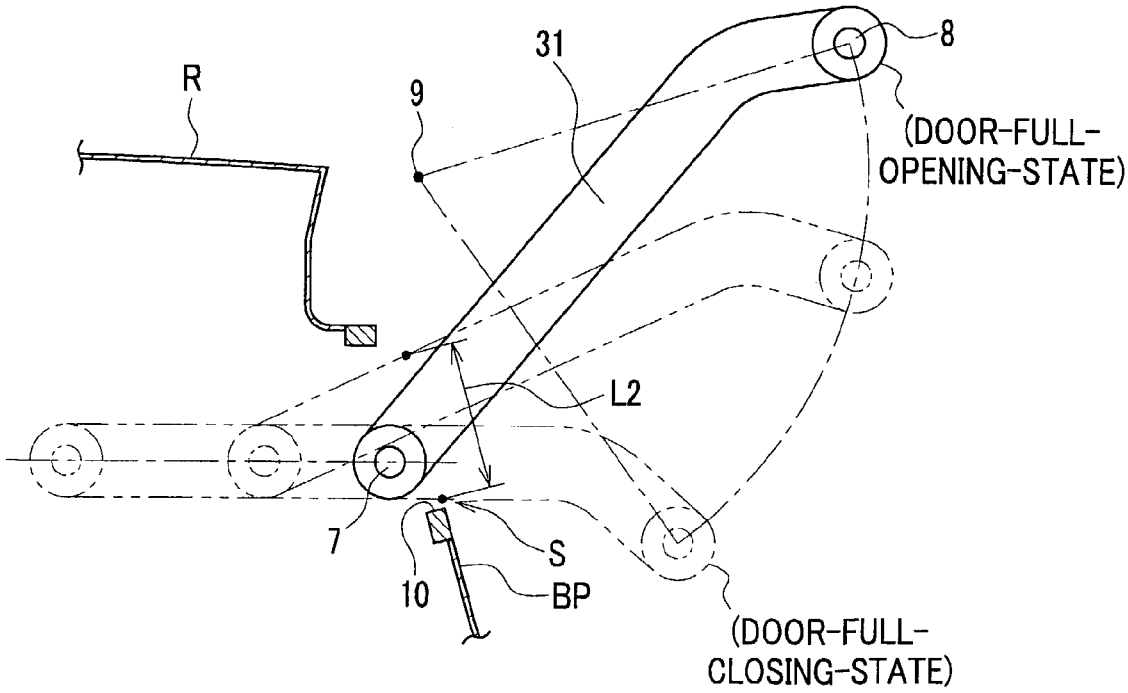

In case where a link member 31 is formed with a straight portion only as shown in FIG. 3B, in a process from a door full-closing-state to a door full-opening-state, the component of a connection part 7 of the link member 31 carries out displacement toward rotation center 9 greatly. Accordingly, the maximum deflection width size (maximum displacement quantity) L2 of the link member 31 becomes large in the through hole 10 (opening S) seen from the rotation axis direction of the door.

On the other hand, in a door-full-opening-state, as shown in FIG. 3A a straight portion 5*b* is positioned in a through hole 10 (opening S), and as a door is opened, curved portion 5*a* serving as a component of a connection part 7, passes across the through hole 10 (opening S). This makes it possible for the curved portion 5*a* to pass the through hole 10 (opening S) without carrying out displacement toward a rotation center 9*a* greatly. More specifically, in a position where the connection part 7 is close to opening S, the link member 5 passes the through hole 10 (opening S) so that substantially arcuate curve (actually in parabolic curve) may be drawn, and in a position where the connection part 7 is distant from opening S, the link member 5 passes across the through hole 10 (opening S) so that substantially linear locus (actually in extremely loose parabolic curve) may be drawn. Accordingly, the maximum deflection width size (maximum displacement quantity) L1 of the member 5 can be made small in the through hole 10 (opening S) seen from the rotation axis direction of the door.

As described thus far, this invention makes it possible to achieve a reduction in the number of parts and also make the deflection width size of a member 5 small, that is, make an interference degree of the member 5 with a load loaded into the circumference of opening S reduced, for example. Therefore, invasion of the water from the through hole 10 to a vehicles compartment or dust can be suppressed as much as possible.

Also, since a link member 5 is attached so as to be capable of carrying out a rotating motion to door D, it moves so that parabolic curve may be drawn as described above. Namely, since the link moves without being regulated by the motion on the arc centering on an axial pin, the moving range in vehicles compartment can be made small as much as possible, to enable an effective use of the space of the vehicles compartment. Whereby, it is easily adapted to the existing vehicles having a restricted use space.

The aforementioned curved portion 5*a* may be formed so that it may have a fixed radius of curvature. Also, in view of a link member 5 which is moving so that parabolic curve may be drawn, if a radius of a curvature is continuously changed in conformity with this parabolic curve, the aforementioned maximum deflection width size L1 can be made smaller. Further, as the curved portion 5*a*, it is not limited to the case where a smooth curve is formed, but even the case where it is crooked sharply, for example in the shape of lining letter "V" if outwardly and protrudingly curved away from a center of rotation of the vehicle door, is included in this invention.

And in this invention, a link member 5 is not consisted of a curved portion only but a straight portion 5*b* is formed in the connection part 8. With employment of this arrangement, the below-mentioned effects of this invention can be obtained. Namely, since the position of the connection part 8 can be spaced apart from the rotation center 9 of the door, a driving force of a driving mechanism 2 required for opening and closing of door D can be small. In addition, since the connection part 8 is located in the space opened comparatively wide, the flexibility of a design of the circumference of the connection part 8 spreads, and attachment work also becomes easy further.

Also, with a composition equipped with 3-dimensional joint mechanism (not shown), such as ball joint or a universal joint, as a connection part 7 and a connection part 8, not only the rotation toward the rotation direction of door D is permitted, but 3-dimensional rotation is also permissible. In view of this, variation in size of attachment of a vehicle body and door D, and variation inside the driving mechanism 2 can be absorbed. A smooth opening-and-closing operation of door D can be thus achieved.

Furthermore, as described above, by inwardly positioning a connection part 7 (vehicles compartment side) from opening S seen from the rotation axis direction, in a full-opening-state of door D, good appearance can be presented and the influence of the rainstorm to the connection part 7 can be reduced as much as possible.

As in the foregoing, preferred embodiment of this invention was described, the layout of each composition element, form, the part numbers, etc. are not limited as shown in the drawings, and can be varied in design freely within the scope of the gist of the invention.

According to this invention, an arrangement with only a link member itself, that is, with only a few numbers of parts can be achieved. And along with this, deflection width size of a member can be made small. In case where a through hole for the link member to be inserted is provided, the size of this through hole can be small.

What is claimed is:

1. An open-and-close mechanism for a vehicle door, which is driven by electric power, comprising:

a driving mechanism disposed in a vehicle compartment and positioned inwardly from a door opening; and an operation transfer mechanism connecting said driving mechanism and said vehicle door; the operation transfer mechanism being equipped with a slider member reciprocatingly and linearly moving by the aid of the driving mechanism, and a link member directly connecting the slider member and the vehicle door, wherein said link member having a first end and a second end, the first end being rotatably connected to the slider member and the second end being rotatably connected to the vehicle door, and said link member is formed to have a curved portion outwardly and protrudingly curved away from a center of rotation of the vehicle door, and the link member is a single body, and wherein said curved portion passes across the door opening in the process of a fully opening and fully closing state of the vehicle door.

2. An open-and-close mechanism for a vehicle door as claimed in claim 1, comprising a connection part rotatably connecting the first end of said link member and said slider member, the connection part being located within a back end panel of the vehicle compartment when the vehicle door is in both the fully opened and the fully closed state.

3. An open-and-close mechanism for a vehicle door as claimed in claim 1, wherein a curvature of said curved portion is continuously changed in conformity with a parabolic locus traced by a movement of said link member.

4. An open-and-close mechanism for a vehicle door as claimed in claim 1, wherein the curved portion of the link member is disposed at the first end, and only curves outwardly and protrudingly away from the center of rotation of the vehicle door.

5. An open-and-close mechanism for a vehicle door, which is driven by electric power, comprising:

driving mechanism disposed in a vehicle compartment and positioned inwardly from a door opening; and operation transferring mechanism connecting the driving mechanism and the vehicle door, the operation transferring mechanism being equipped wit a slider member reciprocatingly and linearly moving by the aid of the driving mechanism, and a link member directly connecting the slider member and the vehicle door, wherein said link member having a first end and a second end, the first end being rotatably connected to the slider member and the second end being rotatably connected to the vehicle door, and said link member includes a straight portion and a curved portion outwardly and protrudingly curved away from a center of rotation of the vehicle door, and the link member is a single body, and wherein said curved portion passes across the door opening in the process of a fully opening and fully closing state of the vehicle door.

6. An open-and-close mechanism for a vehicle door as claimed in claim 5, comprising a connection part rotatably connecting the first end of said link member and said slider member, the connection part being located within a back end panel of the vehicle compartment when the vehicle door is in both the fully opened and the fully closed state.

7. An open-and-close mechanism for a vehicle door as claimed in claim 5, wherein a curvature of said curved portion is continuously changed in conformity with a parabolic locus traced by a movement of said link member.

8. An open-and-close mechanism for a vehicle door as claimed in claim 5, wherein the curved portion of the link member is disposed at the first end, and only curves outwardly and protrudingly away from the center of rotation of the vehicle door.

* * * * *